US008998832B2

(12) United States Patent
Almeida et al.

(10) Patent No.: US 8,998,832 B2
(45) Date of Patent: Apr. 7, 2015

(54) BODY THERAPY DEVICE

(75) Inventors: Robert S. Almeida, Boston, MA (US); Douglas E. Stern, Providence, RI (US)

(73) Assignee: Cellflo, Inc., Providence, RI (US)

( * ) Notice: Subject to any disclaimer, the term of this patent is extended or adjusted under 35 U.S.C. 154(b) by 895 days.

(21) Appl. No.: 13/161,119

(22) Filed: Jun. 15, 2011

(65) Prior Publication Data

US 2011/0313334 A1 Dec. 22, 2011

Related U.S. Application Data

(60) Provisional application No. 61/355,375, filed on Jun. 16, 2010.

(51) Int. Cl.

| | |
|---|---|
| ***A61H 15/00*** | (2006.01) |
| ***A61H 9/00*** | (2006.01) |
| *A61H 7/00* | (2006.01) |
| *A61H 23/02* | (2006.01) |

(52) U.S. Cl.

CPC ..... *A61H 9/0078* (2013.01); *A61H 7/001* (2013.01); *A61H 23/02* (2013.01); *A61H 2015/0071* (2013.01); *A61H 2201/1284* (2013.01); *A61H 2203/0406* (2013.01); *A61H 2203/0425* (2013.01); *A61H 2203/0456* (2013.01); *A61H 2205/04* (2013.01); *A61H 2205/081* (2013.01)

(58) Field of Classification Search

CPC ..... A61H 9/00; A61H 9/0078; A61H 7/00; A61H 7/001; A61H 23/00; A61H 23/02

USPC ..... 601/6, 9, 23, 46, 49, 53, 54, 55, 56, 57, 601/75, 84, 89, 90, 93, 94, 96, 105, 121, 601/122, 128, 134, 148–151; 602/13; 606/204; 482/10

See application file for complete search history.

(56) References Cited

U.S. PATENT DOCUMENTS

| | | | |
|---|---|---|---|
| 3,866,910 | A | 2/1975 | Herring |
| 4,219,193 | A | 8/1980 | Newman |
| 4,233,966 | A | 11/1980 | Takahashi |
| 4,452,237 | A | 6/1984 | Lewis |
| 4,468,023 | A | 8/1984 | Solloway |
| 4,688,556 | A | 8/1987 | Keller, Jr. |
| 4,846,159 | A | 7/1989 | Anzai et al. |
| 4,974,582 | A | 12/1990 | Johnson |

(Continued)

FOREIGN PATENT DOCUMENTS

DE 4205052 A1 8/1992

OTHER PUBLICATIONS

"Backarc", Backarc Products, Inc., http://www.backarc.com/index.php.

*Primary Examiner* — Quang D Thanh

(74) *Attorney, Agent, or Firm* — Barlow, Josephs & Holmes, Ltd.

(57) ABSTRACT

The body therapy device includes a thoracic pad having a top edge and a rear surface with a base having a bottom edge, a front angled surfaced and a rear surface. A spherical member is attached to the angled front surface of the base and includes a hard inner core therein. A pump, with active and passive elements, is provided to enable the user to adjust the hardness of ball portion of the device for customized therapy to a head and neck region. As a result, the device of the present invention is effective for physical therapy and treatment of a wide range of ailments and conditions.

10 Claims, 9 Drawing Sheets

(56) References Cited

U.S. PATENT DOCUMENTS

| | | | | | |
|---|---|---|---|---|---|
| 4,988,093 | A | | 1/1991 | Forrest, Sr. et al. | |
| 5,005,826 | A | | 4/1991 | Merrick | |
| 5,174,282 | A | | 12/1992 | Bleggi | |
| 5,183,034 | A | * | 2/1993 | Yamasaki et al. | 601/134 |
| 5,242,348 | A | | 9/1993 | Bates | |
| 5,267,931 | A | | 12/1993 | Faetini | |
| 5,433,438 | A | | 7/1995 | Gilman | |
| 5,496,244 | A | | 3/1996 | Caruthers | |
| 5,588,168 | A | | 12/1996 | Byrne et al. | |
| 5,637,067 | A | | 6/1997 | Ausmus | |
| 5,713,816 | A | | 2/1998 | Glover | |
| 5,713,841 | A | | 2/1998 | Graham | |
| 5,738,640 | A | | 4/1998 | Carlson-Orsi | |
| 5,810,875 | A | | 9/1998 | Meilus | |
| 5,820,573 | A | * | 10/1998 | Ramos | 601/134 |
| 5,893,808 | A | | 4/1999 | Bennett | |
| 5,913,839 | A | * | 6/1999 | Wincek | 601/134 |
| 5,971,890 | A | | 10/1999 | Tyne | |
| 6,258,047 | B1 | | 7/2001 | Muramatsu | |
| 6,305,040 | B1 | * | 10/2001 | Myler | 601/134 |
| 6,454,680 | B1 | | 9/2002 | Taimela | |
| D472,643 | S | | 4/2003 | Zake | |
| 6,547,703 | B1 | | 4/2003 | Swezey et al. | |
| 6,746,372 | B2 | | 6/2004 | Hsu | |
| D494,233 | S | | 8/2004 | Kerry | |
| 6,821,260 | B2 | | 11/2004 | Fors | |
| 6,921,372 | B2 | | 7/2005 | Shin | |
| 7,087,004 | B1 | | 8/2006 | Berke | |
| 7,118,517 | B1 | | 10/2006 | Hale | |
| 7,156,817 | B1 | | 1/2007 | Cassidy Phillips | |
| 7,189,192 | B2 | | 3/2007 | Edgeton | |
| 7,214,205 | B2 | | 5/2007 | Sils | |
| D547,399 | S | | 7/2007 | Clem et al. | |
| 7,250,032 | B2 | | 7/2007 | Fink | |
| 7,320,668 | B1 | | 1/2008 | Warder | |
| 7,517,324 | B2 | | 4/2009 | Cohen | |
| 7,645,248 | B2 | | 1/2010 | Brown | |
| 2002/0193715 | A1 | | 12/2002 | Slack | |
| 2004/0249322 | A1 | | 12/2004 | Cohen | |
| 2006/0052219 | A1 | | 3/2006 | Roberts et al. | |
| 2008/0077062 | A1 | | 3/2008 | Leiter | |
| 2008/0146979 | A1 | * | 6/2008 | Brown | 601/115 |
| 2010/0076353 | A1 | | 3/2010 | Johnston | |
| 2010/0094333 | A1 | | 4/2010 | Akcasu | |

* cited by examiner

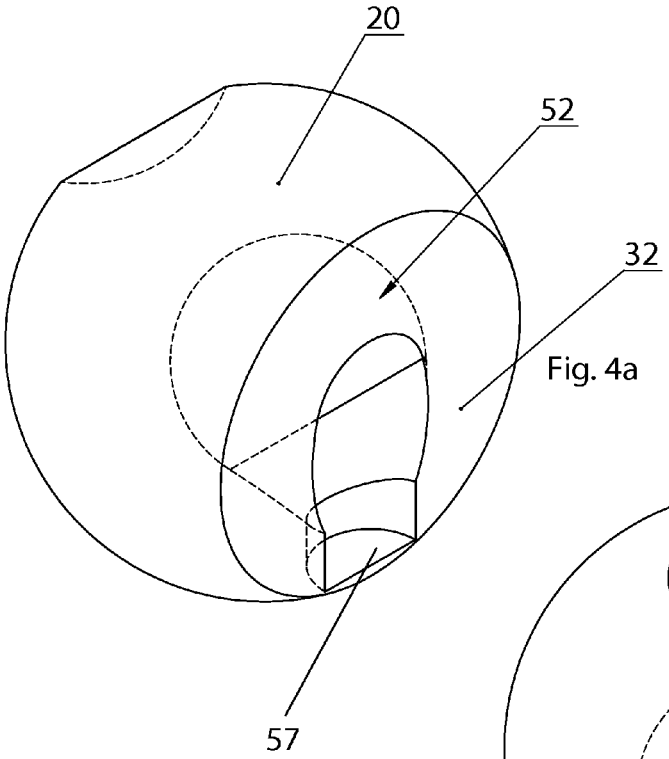
Fig. 4a
Fig. 4b
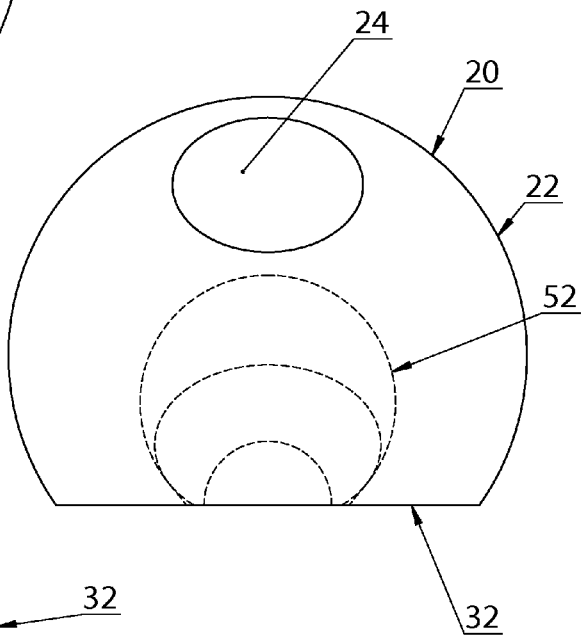
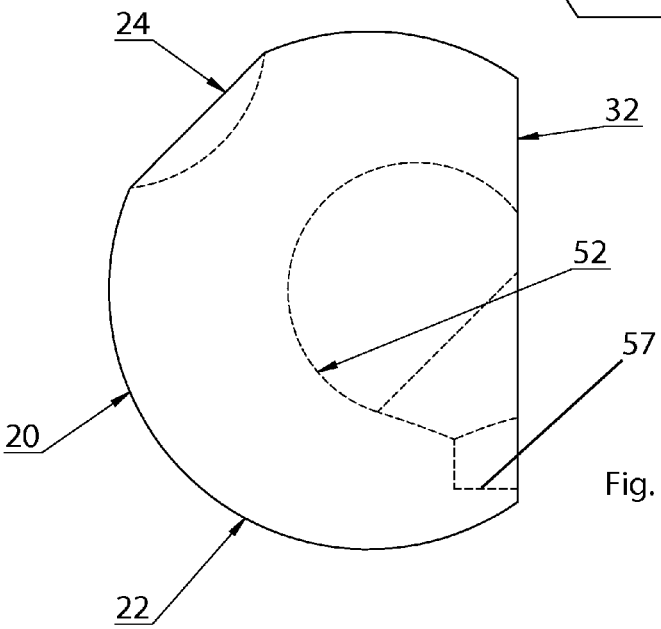
Fig. 4c

BODY THERAPY DEVICE

CROSS REFERENCE TO RELATED APPLICATION

This application is related to and claims priority from earlier filed provisional patent application Ser. No. 61/355,375, filed Jun. 16, 2010, the entire contents thereof is incorporated herein by reference.

BACKGROUND OF THE INVENTION

The invention relates generally to devices and methods to help alleviate neck pain, upper back pain, shoulder pain, headaches, cervical spine sprain and strains such as a cervical spine hyper flexion hyper extension injury or whiplash trauma, and symptoms associated with poor posture, forward head position (FHP), aid in concussion prevention, decrease post concussion syndrome, pain and symptoms from temporal mandible joint dysfunction and cervical spine and spine pathology and general spine pain and muscle tension. Further some attributes of this device will include, but are not limited to: Decreased pain, decreased muscle spasm and tension, increased cervical spine range of motion, stabilize and strengthen cervical spine muscles, ligaments, and tendons among other joint and connective tissues in the cervical spine and other spine regions and body areas and increase in neurological and neurophysiologic function.

In the medical field, nociceptive and neuropathic neck pain, upper back pain, spine pain in a radicular, sclerotogenous, myofacial or dermatomal pattern or general spine pain, shoulder pain, headaches, pain from TMJ dysfunction, pain and symptoms associated with poor posture, forward head position (FHP), post concussion syndrome symptoms, symptoms from concussion and cervical spine and spine pathology, are well known. These above mentioned injuries, conditions, postures and syndromes frequently result in the undesirable functional decreases of the cervical spine region, other aforementioned regional dysfunctions and cervical extensor muscle dysfunction and an imbalance of the flexor and extensor muscle ratio of the cervical spine along with aberrant changes in other structures and function including motion to the above-mentioned regions and decrease of the neurological and neurophysiologic function in these regions. The overall dysfunction of the cervical and thoracic spine joints, muscles, and other connective tissues along with decreased neurophysiologic function contributes to and are causally related to anterior head gravitation, which is also known as, forward head position (FHP). Specifically, downward facing positions and postures cause concurrent hypotonic (lengthening) and hypertonic (shortening) of muscles, ligaments, and tendons, in the said regions, degeneration of cervical spine vertebral facet joints (zygapophysial joints), loss of cervical spine disc height, (disc dessication) and irritation to cervical spine nerves.

The foregoing leads to an anatomical hypolordosis of the cervical spine that, in turn, leads to aberrant cervical spine facet joint movement. Further an anterior forward position of the shoulder in relationship to the body in the coronal or frontal plane occurs, an increased kyphosis of the thoracic spine further occurs, and other postural deficits such as pelvic tilting, and a decrease lumbar lordosis predictably follow. These bio-mechanical instabilities among others, and poor posture lead to neck pain, upper back pain, headaches, temporal mandible joint pain, shoulder and arm pain, radicular pains and symptoms along with lower back pain and other symptoms, dysfunction, and disease.

Further, more serious pathology eventually occurs, such as vertebral subluxations, facet joint arthrosis, spine sprains and strains, disc herniations and extrusions, disc dessication, cervical spine spondylosis, other discs pathology and spine spondylosis, and facet and central cord stenosis, among other conditions. If left untreated FHP can cause lung and vascular disease. Due to decreased function, lung capacity can be decreased 30%, shorter breaths are taken due to bio-mechanical decreases, and thus, capacity of vital lung function decreases. FHP has been found in a recent study to cause a 1.44 greater chance of mortality. FHP is currently an epidemic in our population due to the performance of our daily and work activities. It is expected to worsen as suggested in the evidence base and current research. Causes of these aforementioned conditions include many looking down positions if not all forward cervical spine flexed positions, and repetitive positioning of the head and neck such as; cell phone and smart phone use, texting, driving a vehicle, sitting positions, video game playing, computer use, reading, writing, academic school work type activity, and some sleeping positions.

Further, eating positions and motions, many sports activities, many exercise positions, and any other body position that causes body strain and tension. It is well know that concussions are caused by head trauma, striking the head, and a rapid increase or decrease of head motion, most commonly in a flexion-extension motion and in rotational motions such as an acceleration or deceleration of the head suddenly, creating a force (delta-v) to be received above tolerance to the individual.

There have been attempts in the prior art to provide devices and methods to help with some of the mentioned above tasks including strengthening the muscles of the spine and body in general. Further, there have been devices and methods that assist to attempt in improving posture of the spine and body in general.

For example, prior art devices include padded rollers that can be rolled against some parts and portions of the body that are experiencing pain. This is not adequate to reach all parts of the anatomy of the body and is difficult for the patient to use on himself or herself. It is less or not at all effective on the cervical spine. It further does not deliver active treatment or isotonic therapeutic exercise, (in the evidence base the most effective method), to correct the above conditions and restore function. This method also does not provide the above-mentioned needed elements to correct the aforementioned stated problems that this device patent does promote. It appears not to restore function or create improved posture or structure (anatomy). It is well know in the medical community that to restore posture and form (anatomy), function (physiology), must also be restored. Function needs to be reinitiated most effectively by an active isokinetic modality such as this device patent. It is well know in the literature, that passive attempts are not effective.

Also custom tables, with padding thereon, have been provided on which the patients can lay to help relieve the tension associated with the some of the above activities. This type of passive treatment is further not effective for postural restoration and functional correction. Further, massages by another person are helpful as well as some other professional health provider methods. These are very expensive and cannot be carried out routinely and expediently by licensed professionals or alone by the patient. Without the induction of function restoration, correction is flawed, temporary, or absent. Other attempts have fallen short or failed to provide the same.

However, even these solutions are not enough. There is a demand for a device, as this one, that can be precisely located to target the area of the body that is in need of treatment. There is a need for a device to be able to provide relief from the above conditions. There is a need for a device that can provide different degrees of measurable resistance though a complete range of motion with a required biomechanical delivery to make the therapy delivered effectively.

SUMMARY OF THE INVENTION

The present invention preserves the advantages of prior art body therapy devices. In addition, it provides new advantages not found in currently available body therapy devices and overcomes many disadvantages of such currently available body therapy devices.

The body therapy device includes a thoracic pad having a top edge and a rear surface with a base having a bottom edge, a front angled surfaced and a rear surface. A spherical member is attached to the angled front surface of the base and includes a hard inner core therein. A pump, with active and passive elements, the passive of which resides in the spherical member, is provided to enable the user to adjust the hardness of ball portion of the device for customized therapy to a head and neck region. As a result, the device of the present invention is effective for physical therapy and treatment of a wide range of ailments and conditions.

This device can deliver effective treatment for the above conditions. It can delay, reduced or even reverse the above, by coordinating, re-educating, stabilizing, and strengthening the muscles, ligaments, and tendons, particularly the extensor muscles in the cervical spine and groups of synergistic and antagonistic muscles in the cervical, thoracic, and shoulder regions, and increasing the healthy range of motion of the joints of the spine, particularly the cervical spine. The use of this device will promote functioning cervical spine joints, and regional muscle function, decreasing nociceptive pain induced sclerotogenously and myofacially in the cervical spine and it's referred pain regions of embryological etiology. Further, re-educating the neurophysiology of the spine, particularly the cervical spine kinetics, can also help to delay, reduce, and reverse the above conditions. This device due to its unique isokenitic method and attributes is unchallenged by any other device. It is able efficiently to correct and prevent the above. Because of its ability to contact the head effectively, it is able to improve function in cervical spine muscles, other cervical spine connective tissue, cervical spine joints and neurology, in an unlimited number of plans in 360 degrees and with unlimited trajectory. It can in any imaginable natural motion of the head and neck provided isokinetic resistive and compressive force effectively. Thereby, improving strength to the treated region, and as the medical evidence base shows, decreasing the chance of a future concussion. No other known therapeutic exercise device can complete this task.

This device through resistive and functional isotonic, isokinetic therapeutic exercise will decrease nociceptive polymodal chemical irritation therefore decreasing pain and correct aberrant muscle spindle reflexes and mechanoreceptor dysfunction. These will promote neurological joint function, and orthopedic mechanical function. It will improve neuromuscular cervical spine postural control and cervical spine proprioception. Further, it will reestablish a pain free range of motion in the cervical spine and improve full body posture, and neuromuscular control. It will improve endurance of the cervical spine muscles and improve strength and flexibility to the treated region.

This device provides new advantages not offered or found in currently available devices and overcomes many disadvantages of such currently available devices by improving structure (anatomy) as well as function (physiology). For example: No other device uses isotonic exercise to complete the above-mentioned tasks. Clearly the literature supports this type of treatment for the above conditions over other methods such as other non-active, passive treatments. It is also recommended clearly in the medical field over isometric therapy, as this type of treatment is without movement. Further, if desired, this device can also deliver isometric exercise for the public with congenital or surgically modified or fused cervical spine vertebrae that are without motion.

Therefore, it is an object of the present invention to provide a body therapy device that can be precisely located to target the area of the body that is in need of treatment.

There is a further object of the present invention to provide a body therapy device that can provide relief from a wide range of conditions.

Yet another object of the present invention is to provide a body therapy device that can provide different degrees of measurable resistance though a complete range of motion with a required biomechanical delivery to make the therapy delivered effectively.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

FIG. 4A is a rear perspective view of the foam ball used in the body therapy device of FIG. 1;

FIG. 4B is a front elevational view of the foam ball of FIG. 4A;

FIG. 4C is a right side elevational view of the foam ball of FIG. 4A;

DETAILED DESCRIPTION OF THE PREFERRED EMBODIMENT

Figure 1:
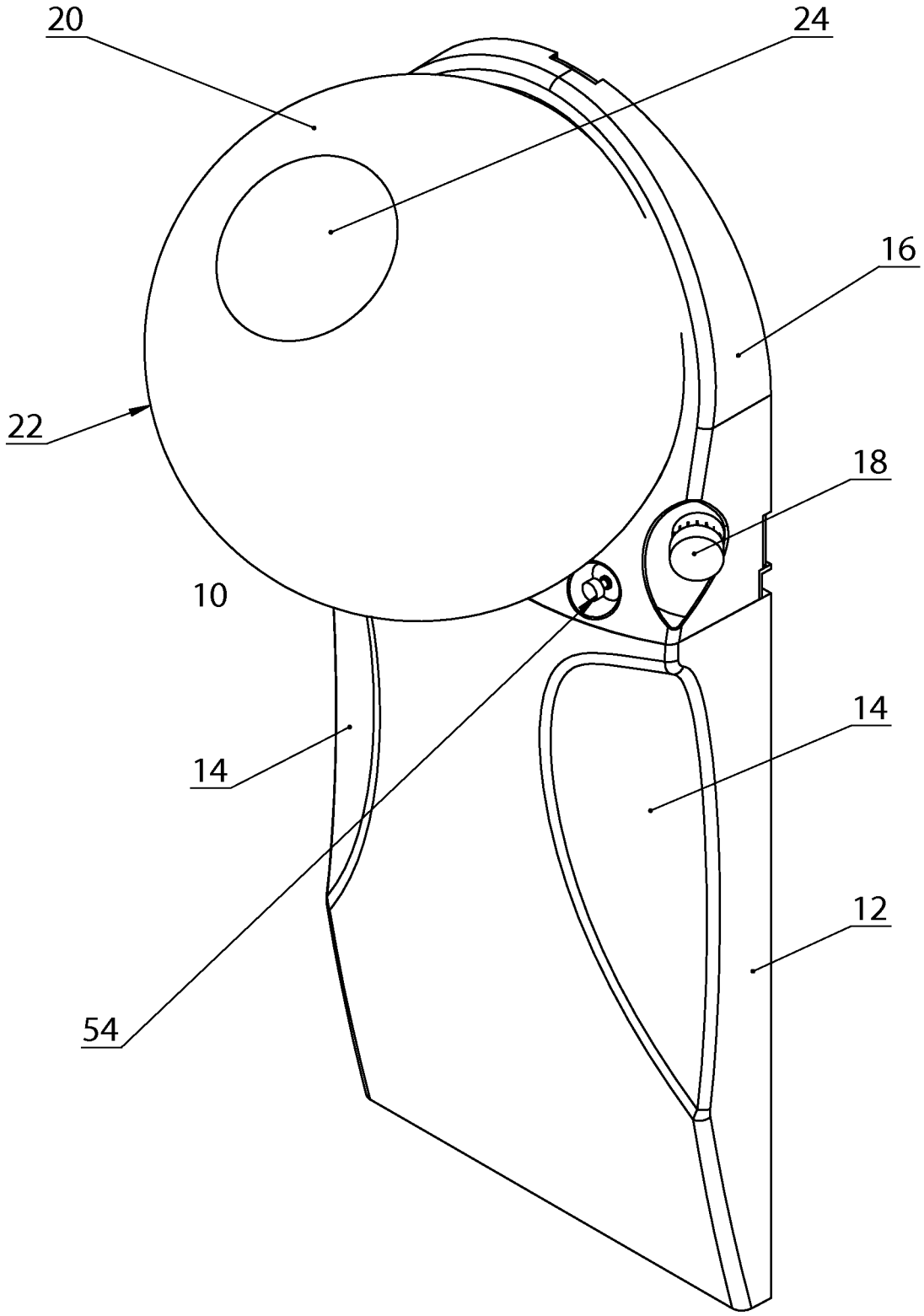
FIG. 1 is a front perspective view of body therapy device of the present invention with posture ball mounted in place.
Figure 2:
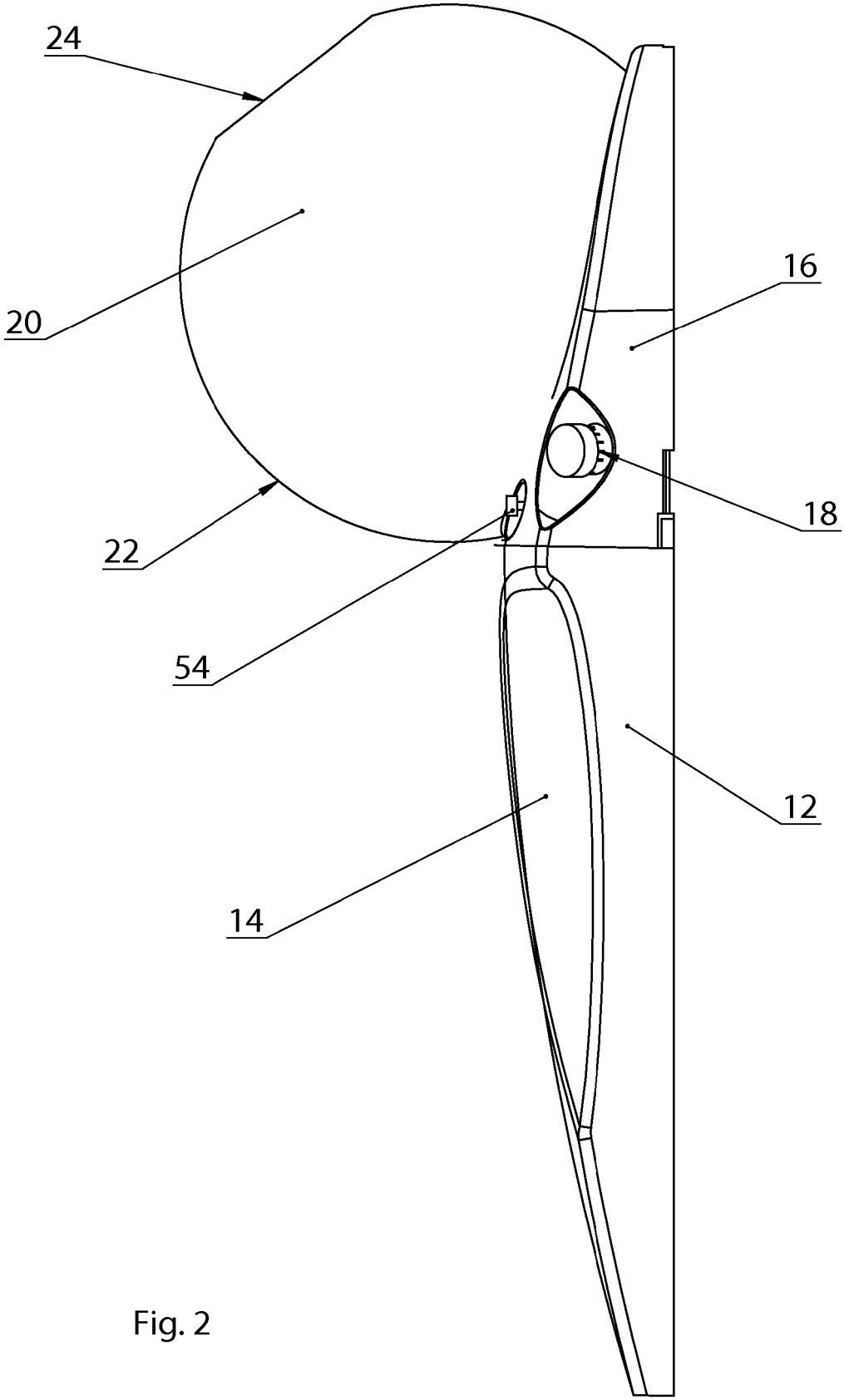
FIG. 2 is right elevational view of the body therapy device of FIG. 1.

In accordance with the present invention, the body therapy device 10 is shown in attached FIGS. 1-7. Referring first to FIGS. 1 and 2, the body therapy device 10 of the present invention is generally shown to include a thoracic pad 12 (also known as a T-Pad) with concavity cut-outs 14 on opposing sides thereof. The thoracic pad 12 is preferably dimensioned to be in the range of 10-12 inches wide, 16-18 inches high and about 2.5 inches thick but may be other dimensions, as needed. An angled substantially hollow base 16 is attached to the top of the thoracic pad 12, which includes a resistance gage 18. Attached to the angled base 16 is a resilient ball 20 with a foam outer shell 22 and an occipital concavity 24 thereon, which is preferably positioned at a 45 degree angle. As will be described below, a power button 54 is provided to control electricity to a oscillator 55, as in FIG. 5*b*.

Figure 3:
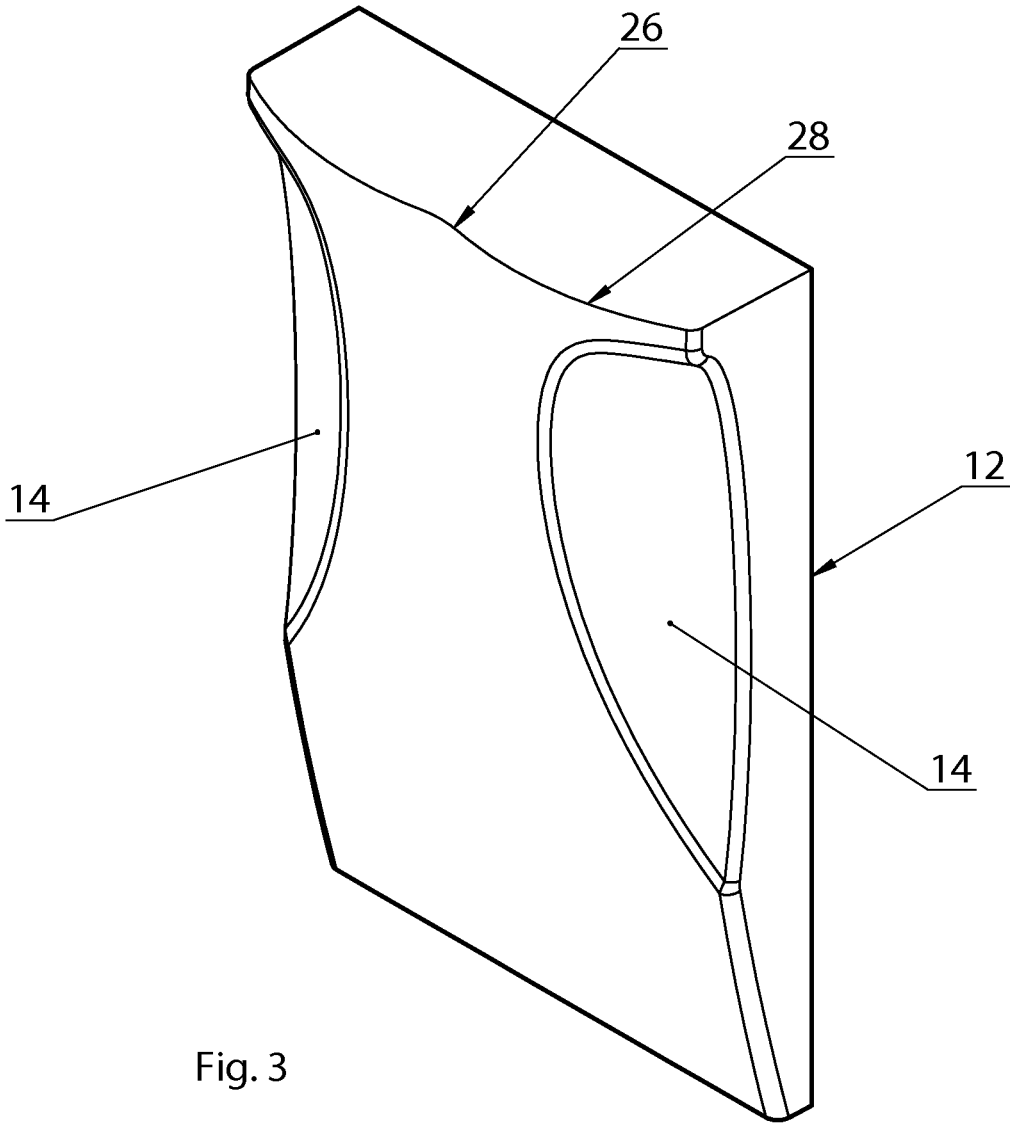
FIG. 3 is a perspective view of the thoracic pad used in the body therapy device of FIG. 1.

FIG. 3 illustrates details of the thoracic pad 12 that is either permanently or removably attached the angled wedge base 16. The size of the thoracic pad 12 is appropriate and can be customized to optimize the support and comfort of the user. The thoracic pad 12 includes a spineous process concavity sulcus and thoracic paraspinuous muscle elevation 28 to reduce pressure on these anatomical prominences. Further, it is illustrated that the thoracic pad 12 also has on each side concavities 14. Further details of the thoracic pad 12 are provided below.

In general, the body therapy device 10 of the present invention includes a cervical spine ball-like member 20 that serves as an excellent modality to perform the above tasks, and aid in the prevention, and relief of the above conditions. It creates fast temporary pain relief, longer lasting biomechanical structural correction, increased physiologic, and neurophysiologic function, and a decrease of the symptoms of FHP, among other health benefits, some of which were mentioned above.

Figure 5A:
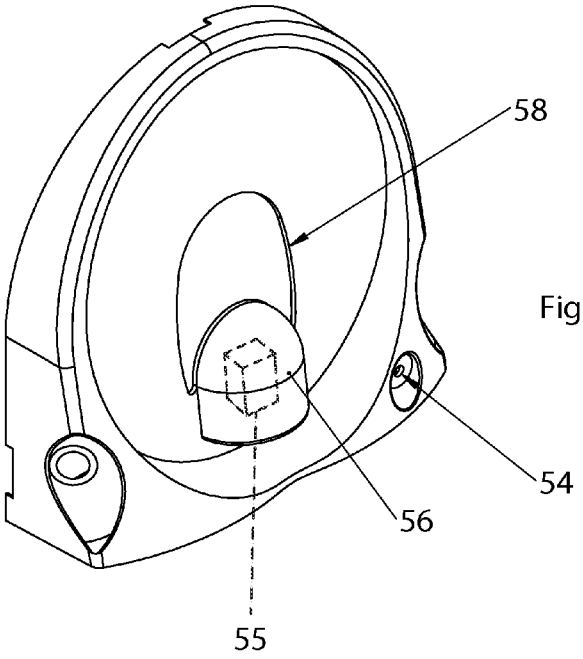
FIG. 5A is a front perspective view of the angled base used in the body therapy device of FIG. 1.
Figure 5B:
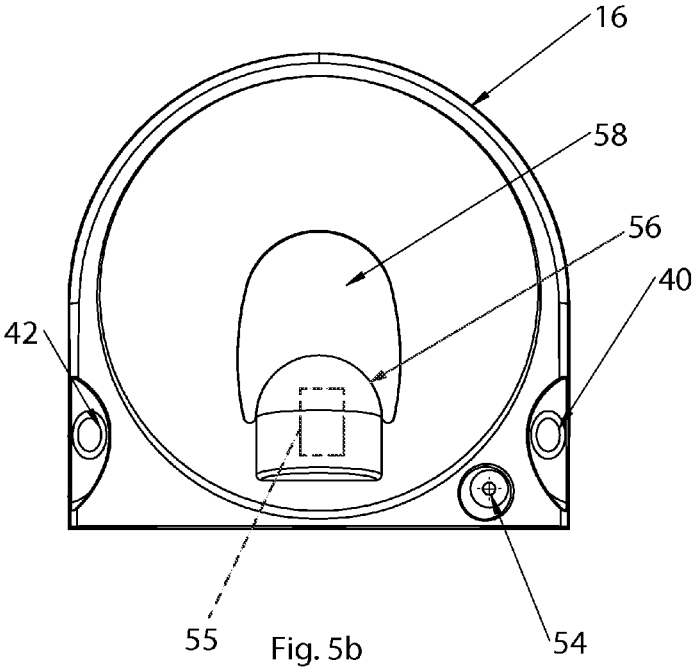
FIG. 5B is a front elevational view of the angled base of FIG. 5A.
Figure 5C:
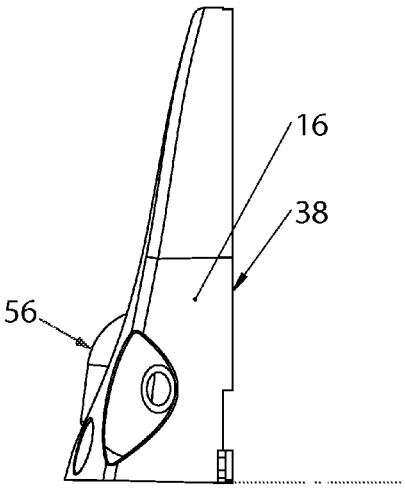
FIG. 5C is a right side elevational view of the angled base of FIG. 5A.
Figure 6A:
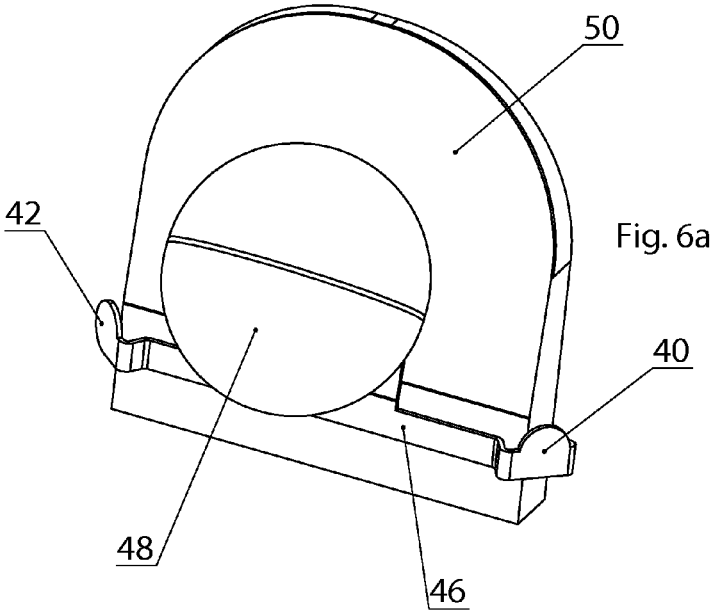
FIG. 6A is a perspective view of the continuance valve region in accordance with the present invention.
Figure 6B:
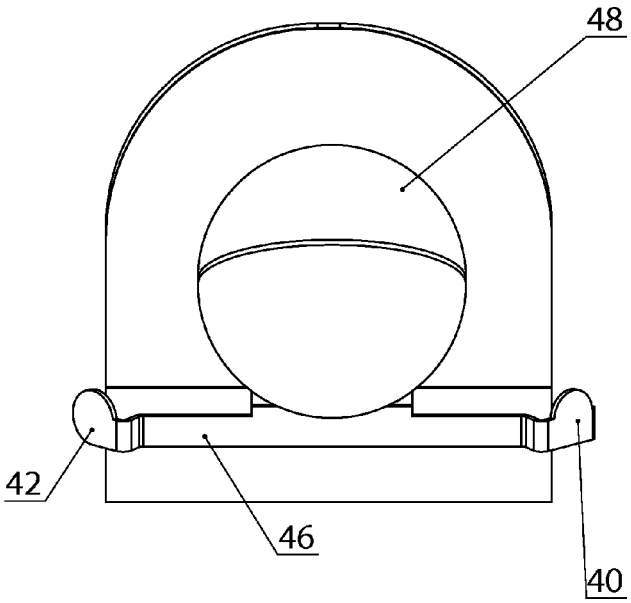
FIG. 6B is a front elevational view of the continuance valve region of FIG. 6A.
Figure 6C:
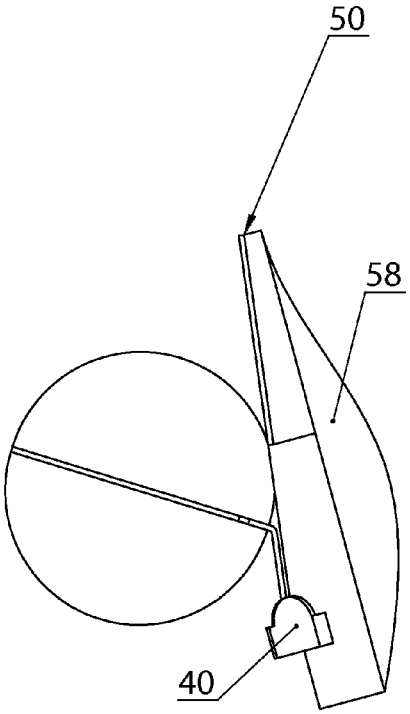
FIG. 6C is a right elevational view of the continuance valve region of FIG. 6A.

Referring now to FIGS. 4*a*-4*c*, details of the resilient ball member 20 used in the body therapy device 10 of the present invention is shown in detail. The resilient ball 20 is of a hollow construction that includes an outer foam rubber cushioning layer 22 to provide a resistive ball-shaped outer member, which comprises the device outer shell 22. The ball member 20 defines a cavity 52 to receive and inflatable passive bladder member 48, as seen in FIGS. 6*a*-6*c*. A lower portion of the cavity 52 defines a recess 57 to receive a rounded inner core portion 56 of the angled base 16, as seen in FIGS. 5*a*-5*c* and FIGS. 8 and 9. The ball member 20 can also be solid foam of other material. This compressive outer shell 22, preferably foam, helps retain the unique shape of the ball-shaper portion 20 of the body therapy device 10 as well as aid in its resistive and compressive therapeutic function.

Further, at the contact point, where the device, namely the resilient ball 20, contacts the head, namely occipital prominence for correction of FHP, is a concavity 24 is oriented at 45 degrees and is circular to contour to the skull at the occipital prominence or any other part of the skull. This concavity 24 ceases ball to head slipping and increases function while in use. Further, still referring to FIG. 4, this unique concavity 24, and it's placement on the device 10, allows for head contact at any imaginable position, to allow for not only extension, but also an isotonic isokinetic exercise in flexion, extension, rotations, and lateral deviations, or any imaginable combination of these natural cervical spine movements. This makes the device 10 capable of restoring strength, normal range of motion, function and aforementioned other positive attributes in any anatomically and physiologically possible and imaginable natural motion or movement that the cervical spine may move, in all daily activities.

Figure 7A:
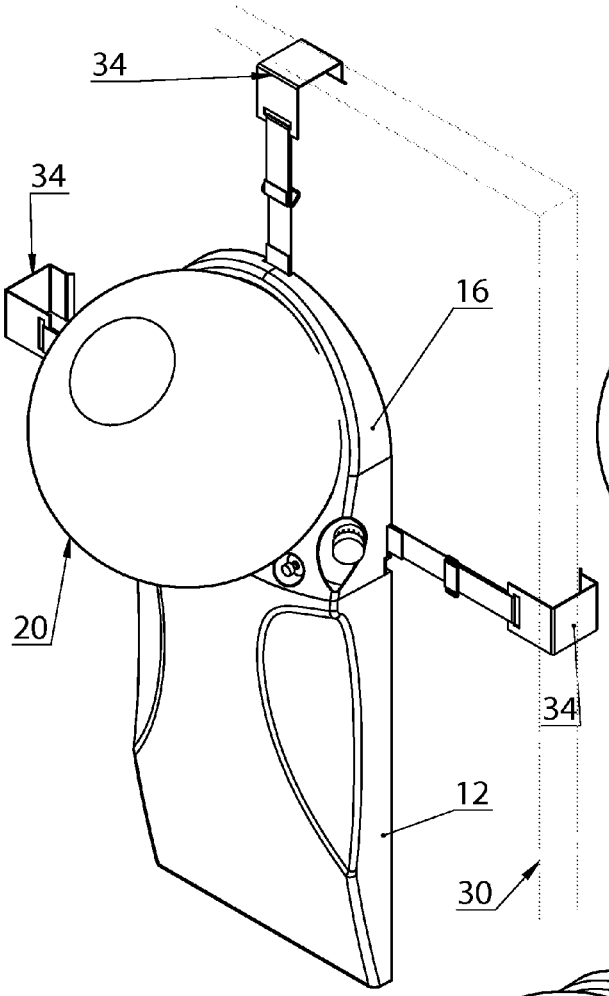
FIG. 7A is a perspective view of the body therapy device of FIG. 1 with a door hanging attachment.
Figure 7B:
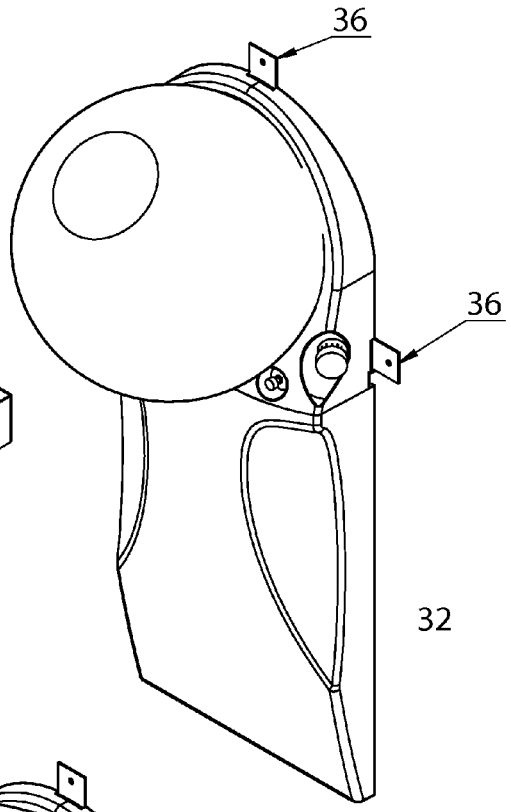
FIG. 7B is a perspective view of the body therapy device of FIG. 1 with a permanent wall attachment.
Figure 7C:
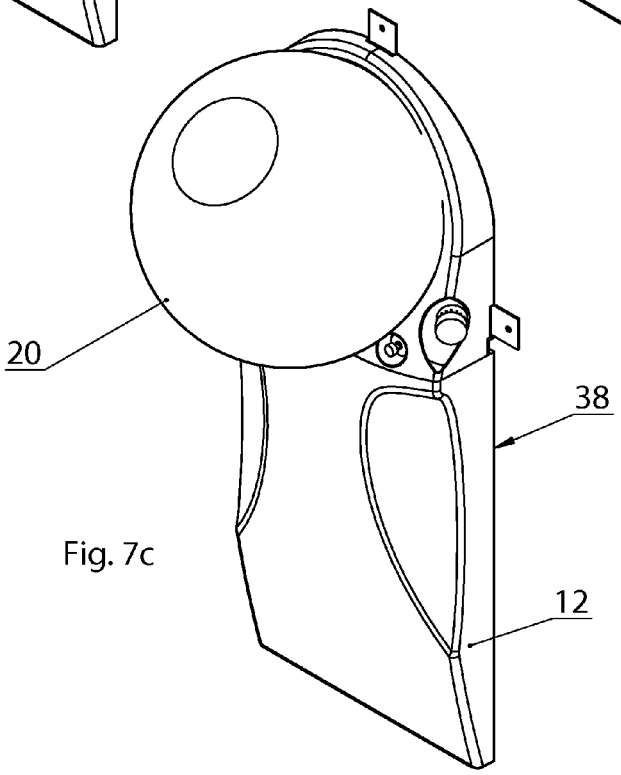
FIG. 7C is a perspective view of the body therapy device of FIG. 1 with a rubber pad for attachment.

As can be seen in FIGS. 7*a*-7*c*, a number of different options for mounting and attaching the body therapy device 10 of the present invention are shown. For example, FIG. 7*a* shows attachment 34 to enable permanent or removable attachment over a door 30. FIG. 7*b* shows use of attachment 36 for permanent or removable attachment to a wall support 32.

The ball portion 20 of the device 10, for example, has a diameter preferably in the range of 8" to 14". The device 10 has approximately a wedge cut or insert 32 at one side of preferably 25%. Any other amount and configuration of wedge cut 32 may be used to address the particular application at hand. The wedge-shaped base 16 may be angled as desired and is configured to adhere to a wall or other support 32 with a non-abrasive, non-marking permanent rubber pad 38 mounted to the flat side, as in FIGS. 5*c* and 7*c*. This restricts sliding and motion against a support surface, such as a wall, floor or other surface, if the device is in use without any accessory attachments.

Additionally, this allows the device 10 to be used while in a supine position (lying on back, face upwards) for those individuals that are unable to stand or sit while using the device 10. Further, as seen in FIGS. 5*a*-5*c*, the cervical spine zygapophysial joints, when the device is used, the unique wedge shape of the angled base 16 best delivers function to allow a uniform and full and complete range of motion during use by the individual. The wedge positioning of the angled base 16 of the body therapy device 10 also has an area for a numerical gage/monitor 40, such as measured in durometer hardness, air resistance or other units of measure, and pressure release and valve pump 42, which can also be seen in FIG. 5*a*-5*c*. The valve pump 42 is preferably manual but can also be electrically powered (not shown) and is turned on and off by power switch 54. This functionality is preferably embedded in the sides of the angled base 16. This is to measure and display the air resistance numerically, namely force resistance, and to increase or decease such resistance to ensure efficient and proper use and therapy delivery to the consumer.

As can be seen in FIGS. 6*a*-6*c*, attached to the pressure gage 40 and valve pump 42 is a tube 46 that connects to a passive cell portion 48 of the family cell 50 to transfer air pressure, and create a measured and adjustable, namely increase or decrease, resistance in the device 10. It should be noted that the gage 40 and valve pump 42 are representationally shown in the figures, such as in FIGS. 6*a*-6*c*. The cell 50 resides in the angled base to provide an active cell 58. Passive cell 48 is fluidly connected to active cell 58 via tubes 46. Passive cell 48 resides within ball portion 20, namely within cavity 52, to effectively control the amount of inflation of the ball portion 22 and, thereby, the hardness of the ball portion for customized treatment. Rounded inner core portion 56 of the angled base 16 resides in recess 57 in the rear side of ball member 20. As a result, oscillator is provided close to the ball member 20 to provide the optional vibration therapy, as described above.

Still referring to FIGS. 6*a*-6*c*, the entire of the family cell 50 and active cell 58 resides within the angled base 16. In FIG. 6*c*, the active cell 58 is bulging rearwardly, however, when it resides within the substantially hollow angled base 16, the active cell 58 will be contained therein and provide the required back-pressure to the passive cell 48, which resides inside the ball member 20 to provide the adjustable inflation and associated hardness thereto.

The ball portion 20 receives the rounded inner core portion 56, which may be 2-inch diameter (or other appropriate size), as can best be seen in FIGS. 5*a*-5*c*. The inner core 55 is preferably semi-spherical at the top and semi-cylindrical at its lower portion but may be of other shape. The inner core 56 is attached or built into to the angled hard plastic wedge base 16 of the device 10 and houses the oscillator 55 therein. It is preferred that this is the location of an optional oscillator 55, as in FIG. 5*b*, to add optional vibratory therapy to one or more versions of our therapy device. Power button 54, as seen in FIGS. 1, 2, 5*a*-5*c* turns on power to the oscillator 55 from a power source (not shown), such as AC or DC power. Such vibration therapy further helps promote neurological joint function, and improve neuromuscular, and neurophysiologic cervical spine postural control, proprioception and movement.

Figure 8:
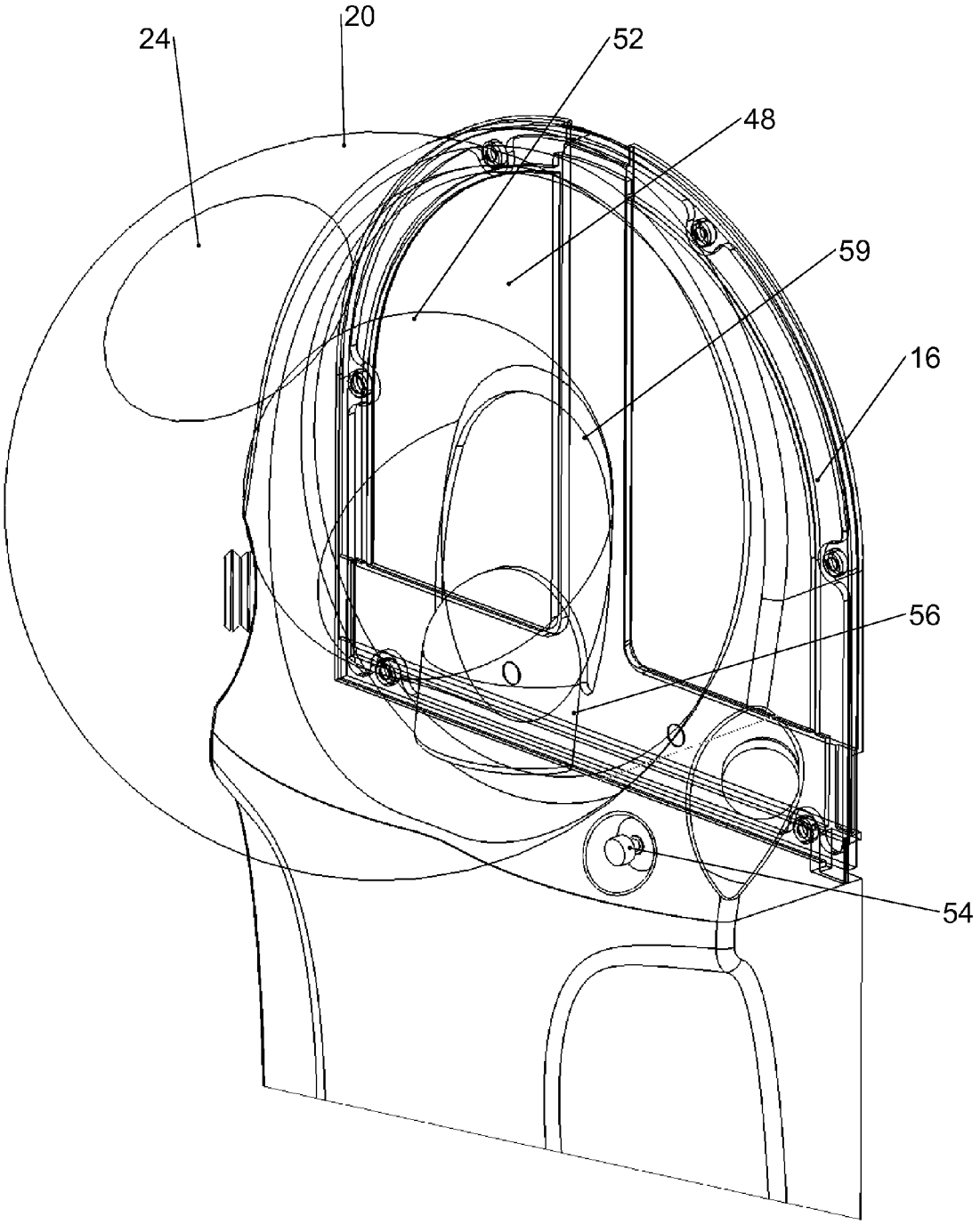
FIG. 8 is a front perspective view of the body therapy device of FIG. 1 with portions in shadow for illustration purposes.
Figure 9:
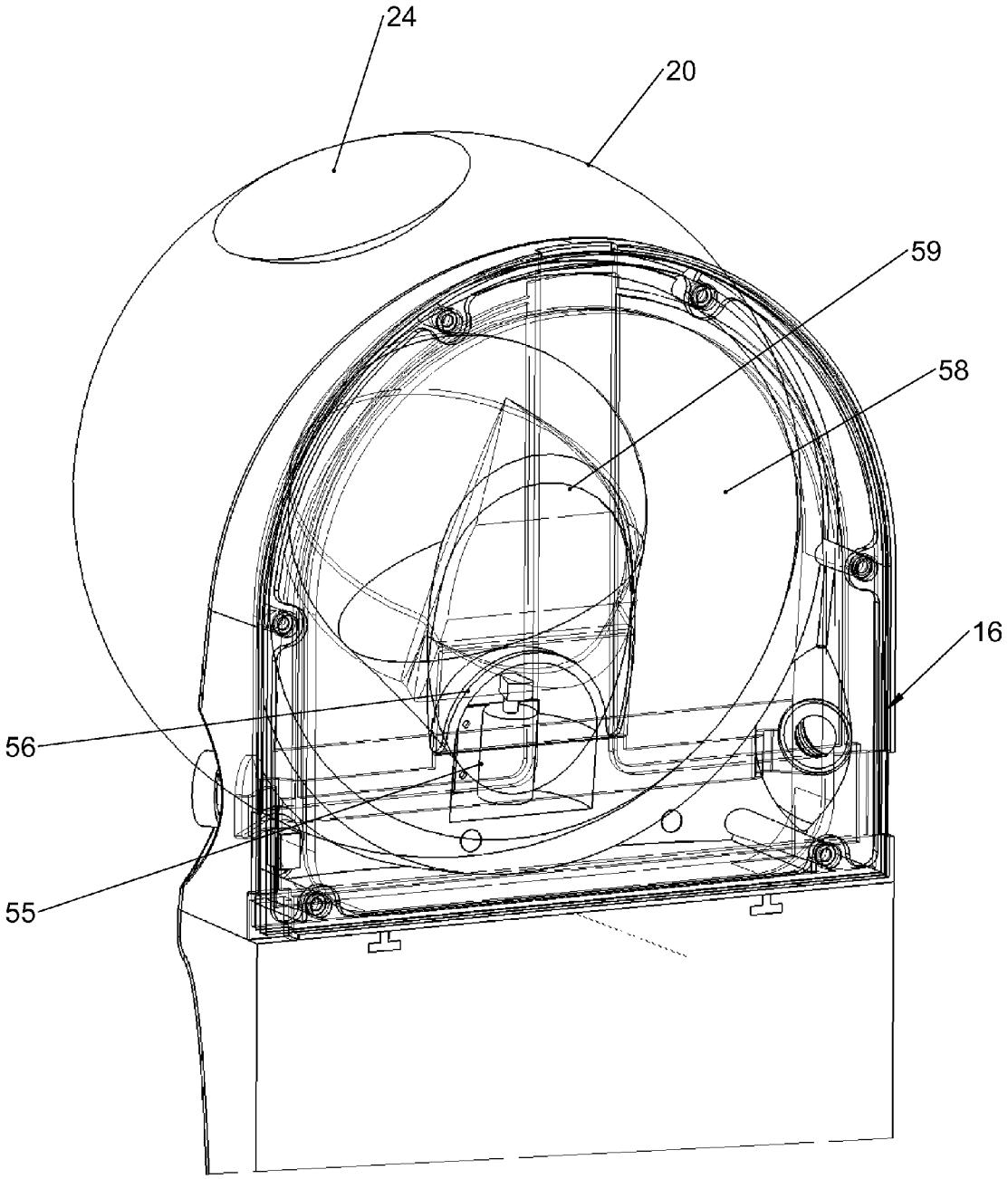
FIG. 9 is a rear perspective view of the body therapy device of FIG. 1 with portions in shadow for illustration purposes.

As seen further seen in FIGS. 8 and 9, the rounded inner core portion resides in recess 57 of cavity 52 while the passive cell 48 of the family cell 50 resides in the cavity 52. The passive cell 48 and active cell 58 are fluidly interconnected to one another via passage 49. This construction provides a continuous variable renewable air cell technology that allow this device 10 to uniquely and effectively function. Such renewable air technology is the subject of co-pending and commonly owner U.S. Provisional Patent Application Ser. No. 61/489,858, filed on May 25, 2011, the entire contents thereof are incorporated herein by reference. The shape of the passive cell 48 is circular, abalone, tear drop, rain drop, or balloon shaped with a larger diameter at the head of the device contact point, where the concavity is present on the outside of the foam outer covering, and a slim diameter at the furthest point in the ball from head contact, where the 2 inch diameter or other size hard plastic inner core 52 is located, and a continuance valve 59 that leads to the active cell 58. This unique shape allows for a more precise compression of the device though a normal and complete range of motion during use. Resistance of the family cell 50 preferably increases easiest to hardest, at the desire of the user by the attached valve pump 42 on the angled wedge base 16 of the device 10.

The passive cell 48, as compressed by the compression of the head by the cervical spine movement during use, will in degrees of resistance match the leverage force created by the seven anatomical vertebral segments of the cervical spine and its connective tissues and muscles as the cervical spine moves though an extension range or any other imaginable range in a 360 degree motion. This allows for a measured, calibrated, and consistently graduated increased resistive force as the leverage created physiologically by the cervical spine muscles and other structures during exercise increases.

It is well know physiological fact that about 80% of flexion and extension of the cervical spine is produced in the first two cervical spine vertebral segmental movement (vertebrae C1 and C2). The device 10 of the present invention has its design and method configured to acknowledge this anatomical and physiological fact into account and produced its unique shaped family cell 50 comprised of the active 58 and passive cell 48, to create appropriate resistance for those, and all remaining levels of the cervical spine during use and in rehabilitation as needed. The cervical spine structures react to the biomimicry of continuous variable renewable air cell technology of the single passive cell 48 or multiple active 58 and passive cells 48 or chambers of the family cell 50 and mirror the resistance of the structures in action and movement, thus increasing the effectiveness of the therapy.

The unique shape of the angled wedge base 16 also serves to protrude the device 10 toward the head where the device's concaved contact point is angled, such as at 45 degrees upward, for user efficiency. This 45-degree angle upward is intended to approximately match the degree of anatomical angle of the cervical facet joints at vertebrae C3-C7. This facilitates a symmetrical, fluid, and physiological cervical spine movement during exercise. Further, the ball portion 20 has a built in holder, flush to the flat side 32 of the ball, for a hook or attachment for a rack, as described above.

Further details of mounting or attaching the device is shown in FIGS. 7*a*-7*b*. The mount supports 34, 36 allow the height of the device 10 to be adjusted for the height and needs of the user. Further permanently attached or removably attached to the bottom off the 45-degree angled wedge base is the thoracic pad 12. The thoracic pad 12 may be of any size or configuration to suit the user's needs. Its size is appropriate for support and comfort of the user. FIG. 3 shows a spineous process concavity sulcus 26, 28 to reduce pressure on these anatomical prominences. Further, it is illustrated that the thoracic pad 12 also has on each side concavities 14. The size, shape, and placement is intended to reduce tension and allow more comfort for the scapular region, shoulder area, and upper arm when the device is in use. However, the size and location of the concavities 14 may be configured, as needed.

Also, the thoracic pad 12 aids in positioning the upper torso and head and neck in an advantageous position and angle for optimum function while the device 10 is in use. Additionally, the thoracic pad 12 creates a subtle passive stretch in some of the muscles typically hypertonic in the those suffering with FHP, such as the pectoralis major and minor muscles. In FIG. 3, it is shown that the thoracic pad 12 has the thoracic paraspinal surface profiling 26, 28 for this purpose.

Multiple embodiments of the invention are envisioned to suit the environment into which the ball-like portion 12 is installed. As seen in FIGS. 7*a*-7*c*, there are many options for mounting and attachment of the device 10. A professional and over-door attachment rack 34 may hang over the top of a door 30, as seen in FIG. 7*a*. This is in contrast to the support being mounted to a wall. As in FIG. 7*b*, it is also possible that the mount attachment 36 be screwed directly into a support wall 32, such as to a stud, for use. As seen in FIGS. 5*c* and 7*c*, it preferred that the rear side of the thoracic pad 12 and/or the angled wedge base 16 include a pad 38 made of rubber or other material to prevent sliding and other movement of the device 10 on a support surface.

The finish of the device 10 is preferably anti-bacterial, hypoallergenic and easy to clean. It is imaginable that many different colors and or logos may be applied to the device surface for customization. It is also envisioned that there will be, for example, that ultrasonic gel, foam, water or other substrate or combination of such substrates in the multiple cells or chambers may be substituted for air in a given version of the device. The variable resistance of the device 10 may be any level suitable to provide the needed range of resistance to the user. The continuous variable air cell technology of the present invention allows for proper functional resistance according to the capabilities of the user, is measurable, adjustable, and suitable for providing the needed resistance to a given body part, such as a neck or spine, to carry out the aforesaid therapy to children, females, and males of varying sizes, strengths and capabilities.

This device of the present invention is unique over prior art devices due to its method and use, utility, and novel material combination, shape, design, wide range of attachment options, and implanted attachment in ball 20 for attachment to a support surface, including use in a supine position on the wood or other hard or padded table surface. The device 10 of the present invention has specific targeted uses that enables it to provide treatment that is much more effective and unique than prior art devices, and deliver therapy that no other prior device has accomplished.

It is envisioned that the device of the present invention be suitable for DO, MD, DC, PT, rehabilitation facilities, distributor vendors of rehabilitation products, schools and colleges, sports teams, all public with neck pain and conditions, symptoms, and pathology as stated earlier in this patent through internet sales, possibly direct retail, and eventually retail in stores everywhere.

It is also possible that the device 10 of the present invention can be used in conjunction with other products to provide additional therapy treatment. These products may include but not be limited to: cervical pillows, cervical half pillows, tubing, rubber bands, foam rollers, and other products that present some support or treatment to the body. An instructional DVD, exercise user program or protocol and user manual is preferably included with the product of the present invention. It is understood that holistic system approach to therapy would be used in cooperation with resistive band exercises that further may be incorporated into the structure of some of the therapy housings or as an adjunct device integrated into a system approach to maximize efficiency.

It would be appreciated by those skilled in the art that various changes and modifications can be made to the illustrated embodiments without departing from the spirit of the present invention. All such modifications and changes are intended to be covered by the appended claims.

What is claimed is:

1. A body therapy device, comprising:

a thoracic pad having a top edge, thoracic spine sulci, and thoracic paraspinal muscle elevations; and a rear surface;

an angled base having a front angled surface and a bottom edge;

a spherical member attached to the front angled surface of the base to provide an approximate 45 degree angled contact point relative to the ground;

whereby therapy is deliverable to head, neck and mid back regions of a user.

2. The body therapy device of claim 1, further comprising:

an active cell portion residing in the base;

a passive cell portion residing in the spherical member and fluidly interconnected to the active cell portion;

a valve pump fluidly interconnected to the passive cell portion to initially fill the passive cell with media therein to deliver varying degrees of resistance to the spherical member.

3. The body therapy device of claim 2, wherein the spherical member is fluidly connected to a continuance valve that permits air flow between the passive cell portion and the active cell portion.

4. The body therapy device of claim 1, wherein the spherical member defines an occipital concavity.

5. The body therapy device of claim 4, wherein the occipital concavity is angled approximately 45 degrees relative to ground.

6. The body therapy device of claim 1, wherein the top edge of the thoracic pad and the bottom edge of the base are connected to each other.

7. A body therapy device, comprising:

a thoracic pad having a top edge, thoracic spine sulci, and thoracic paraspinal muscle elevations; and a rear surface;

an angled base having a front angled surface and a bottom edge;

a spherical member attached to the front angled surface of the base to provide an approximate 45 degree angled contact point relative to the ground; the spherical member being fluidly connected to a continuance valve that permits air flow between the passive cell portion and the active cell portion;

an active cell portion residing in the base;

a passive cell portion residing in the spherical member and fluidly interconnected to the active cell portion;

a valve pump fluidly interconnected to the passive cell portion to initially fill the passive cell with media therein to deliver varying degrees of resistance to the spherical member;

whereby therapy is deliverable to head, neck and mid back regions of a user.

8. The body therapy device of claim 7, wherein the spherical member defines an occipital concavity.

9. The body therapy device of claim 8, wherein the occipital concavity is angled approximately 45 degrees relative to ground.

10. The body therapy device of claim 7, wherein the top edge of the thoracic pad and the bottom edge of the base are connected to each other.

* * * * *